US010912343B1

(12) United States Patent
Blaylock

(10) Patent No.: US 10,912,343 B1
(45) Date of Patent: Feb. 9, 2021

(54) SECRETIVE MULTIPURPOSE CARRYING SYSTEM

(71) Applicant: Brenda Blaylock, Decatur, TX (US)

(72) Inventor: Brenda Blaylock, Decatur, TX (US)

( * ) Notice: Subject to any disclaimer, the term of this patent is extended or adjusted under 35 U.S.C. 154(b) by 205 days.

(21) Appl. No.: 15/430,421

(22) Filed: Feb. 10, 2017

Related U.S. Application Data

(60) Provisional application No. 62/293,577, filed on Feb. 10, 2016.

(51) Int. Cl.
*A41D 23/00* (2006.01)
*A41D 27/20* (2006.01)

(52) U.S. Cl.
CPC ..... *A41D 23/00* (2013.01); *A41D 27/201* (2013.01); *A41D 27/205* (2013.01)

(58) Field of Classification Search
CPC ..... A41D 13/08; A41D 23/00; A41D 27/201; A41D 27/205
USPC ..... 2/91, 207, 208
See application file for complete search history.

(56) References Cited

U.S. PATENT DOCUMENTS

| | | | | |
|---|---|---|---|---|
| 2,051,274 | A * | 8/1936 | Rubens | A41D 23/00 2/91 |
| 4,037,340 | A * | 7/1977 | Owensmith | G09F 17/00 40/586 |
| 4,488,315 | A * | 12/1984 | Hoerlein | A41D 23/00 2/91 |
| 6,537,235 | B1 * | 3/2003 | Connor | A41D 23/00 2/207 |
| D674,563 | S * | 1/2013 | Reilly | D30/145 |
| 8,468,612 | B1 * | 6/2013 | Galloway | A41D 23/00 2/207 |
| 9,138,022 | B2 * | 9/2015 | Walker | A41D 27/205 |
| 2005/0125878 | A1 * | 6/2005 | Bjelland | A41D 23/00 2/207 |
| 2007/0033706 | A1 * | 2/2007 | Kuhlmann | A41D 23/00 2/207 |
| 2010/0235963 | A1 * | 9/2010 | Haydon | A41D 13/1245 2/207 |

* cited by examiner

*Primary Examiner* — Timothy K Trieu
(74) *Attorney, Agent, or Firm* — Richard Eldredge; Leavitt Eldredge Law Firm

(57) ABSTRACT

A secretive multipurpose carrying system conceals the presence of a closable pouch with a garment. The pouch is concealed by a plurality of gathers attached to the garment. Personal effects can be stored in the pouch and hidden from view in this manner.

1 Claim, 5 Drawing Sheets

SECRETIVE MULTIPURPOSE CARRYING SYSTEM

BACKGROUND

1. Field of the Invention

The present invention relates generally to carrying systems, and more specifically, to an integrated carrying system where the carrying system is embedded within an article of clothing.

2. Description of Related Art

Integrated carrying systems are well known in the art and are effective means to incorporate a purse into an article of clothing. For example, FIGS. 1A and 1B depict a conventional integrated carrying system 101 having a sash 103 with a closable pouch 105 integral to the body 115 of the sash 103. During use, personal effects 107, 109, 111 are placed in the closeable pouch 105 within the sash 103 which is worn by a person 113.

One of the problems commonly associated with system 101 is theft of the personal effects. For example, a thief can easily determine that there are potentially valuable items in the integrated carrying system 101 making the person 113 a target for theft.

Accordingly, although great strides have been made in the area of integrated carrying systems, many shortcomings remain.

DESCRIPTION OF THE DRAWINGS

The novel features believed characteristic of the embodiments of the present application are set forth in the appended claims. However, the embodiments themselves, as well as a preferred mode of use, and further objectives and advantages thereof, will best be understood by reference to the following detailed description when read in conjunction with the accompanying drawings, wherein:

FIG. 4 is a front view of the system of FIG. 3; and

Figure 1A:
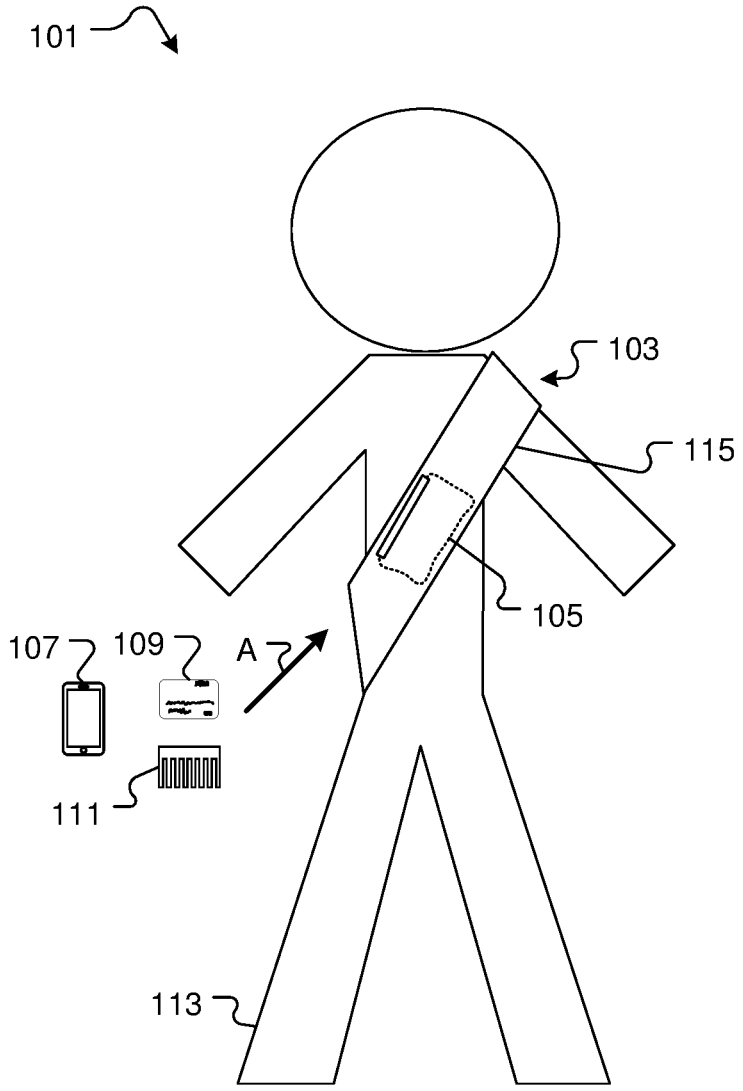
FIG. 1A (Prior Art)
FIGS. 1A and 1B are front views of a common integrated carrying system.
Figure 1B:
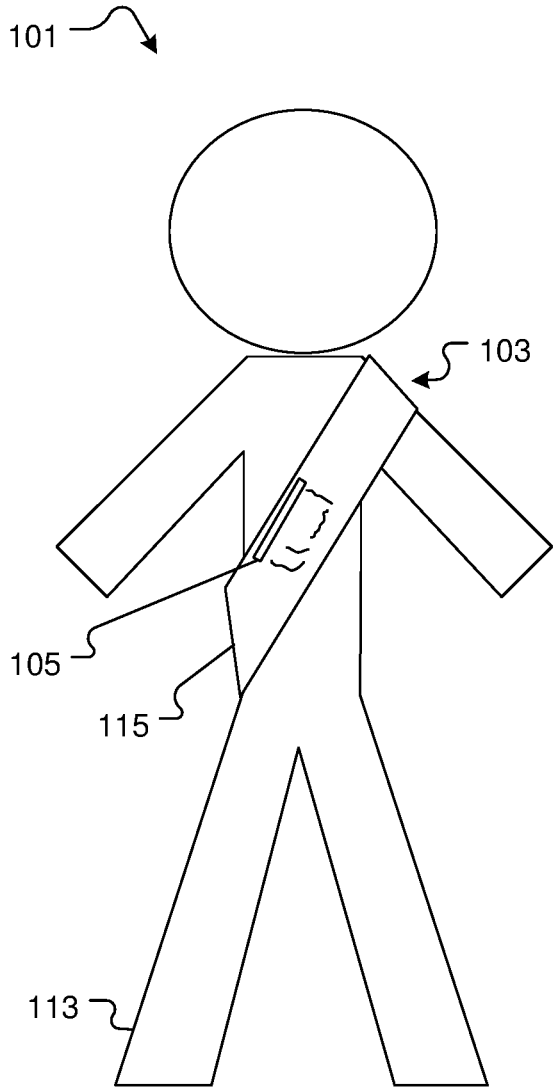
FIG. 1B (Prior Art)

While the system and method of use of the present application is susceptible to various modifications and alternative forms, specific embodiments thereof have been shown by way of example in the drawings and are herein described in detail. It should be understood, however, that the description herein of specific embodiments is not intended to limit the invention to the particular embodiment disclosed, but on the contrary, the intention is to cover all modifications, equivalents, and alternatives falling within the spirit and scope of the present application as defined by the appended claims.

DETAILED DESCRIPTION OF THE PREFERRED EMBODIMENT

Illustrative embodiments of the system and method of use of the present application are provided below. It will of course be appreciated that in the development of any actual embodiment, numerous implementation-specific decisions will be made to achieve the developer's specific goals, such as compliance with system-related and business-related constraints, which will vary from one implementation to another. Moreover, it will be appreciated that such a development effort might be complex and time-consuming, but would nevertheless be a routine undertaking for those of ordinary skill in the art having the benefit of this disclosure.

The system and method of use in accordance with the present application overcomes one or more of the above-discussed problems commonly associated with conventional multipurpose carrying systems. Specifically, the system of the present application conceals a storage compartment within a garment minimizing the risk of identifying the presence of personal effects and the theft of them. This and other unique features of the system and method of use are discussed below and illustrated in the accompanying drawings.

The system and method of use will be understood, both as to its structure and operation, from the accompanying drawings, taken in conjunction with the accompanying description. Several embodiments of the system are presented herein. It should be understood that various components, parts, and features of the different embodiments may be combined together and/or interchanged with one another, all of which are within the scope of the present application, even though not all variations and particular embodiments are shown in the drawings. It should also be understood that the mixing and matching of features, elements, and/or functions between various embodiments is expressly contemplated herein so that one of ordinary skill in the art would appreciate from this disclosure that the features, elements, and/or functions of one embodiment may be incorporated into another embodiment as appropriate, unless described otherwise.

The preferred embodiment herein described is not intended to be exhaustive or to limit the invention to the precise form disclosed. It is chosen and described to explain the principles of the invention and its application and practical use to enable others skilled in the art to follow its teachings.

Figure 2:
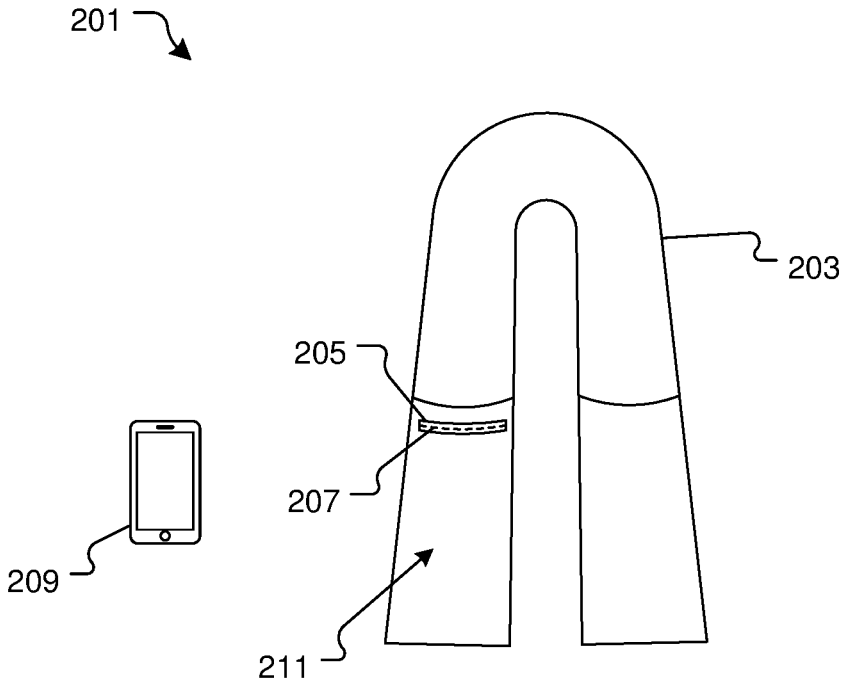
Figure 3:
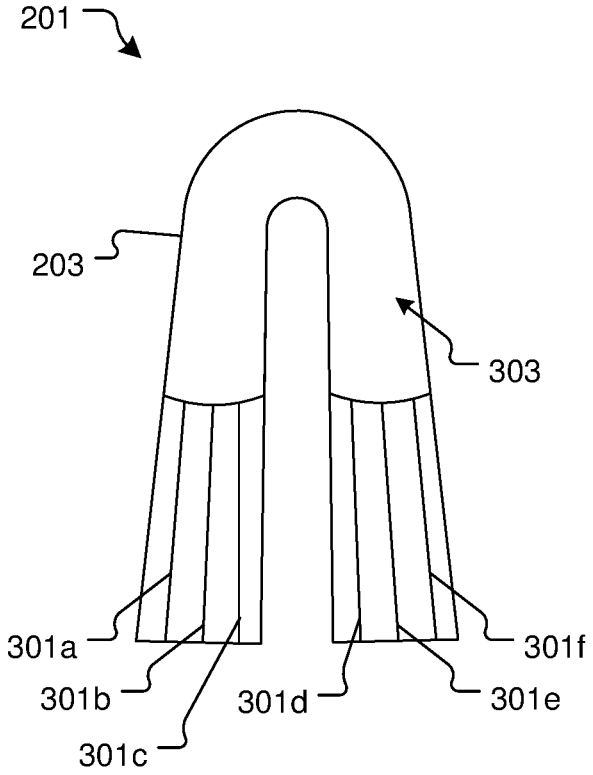
FIG. 3 is a back view of a secretive multipurpose carrying system in accordance with a preferred embodiment of the present application.

Referring now to the drawings wherein like reference characters identify corresponding or similar elements throughout the several views, FIGS. 2 and 3 depict a rear and front view respectively of a secretive multipurpose carrying system 201 in accordance with a preferred embodiment of the present application. It will be appreciated that system 201 overcomes one of more of the above-listed problems commonly associated with conventional integrated carrying systems.

In the contemplated embodiment, system 201 includes a garments 203 depicted as a scarf with an integrated pouch 205 for carrying personal effects 209. In the current embodiment the pouch is accessible from the back surface 211 of the garment 203 via a zipper 207. The garment 203 also having a plurality of gathers 301 rigidly attached to the front surface 303 of the garment in front of the integrated pouch 205 configured to conceal the presence of both the pouch 205 and any effects 209 stored in the pouch 205.

Figure 4A:
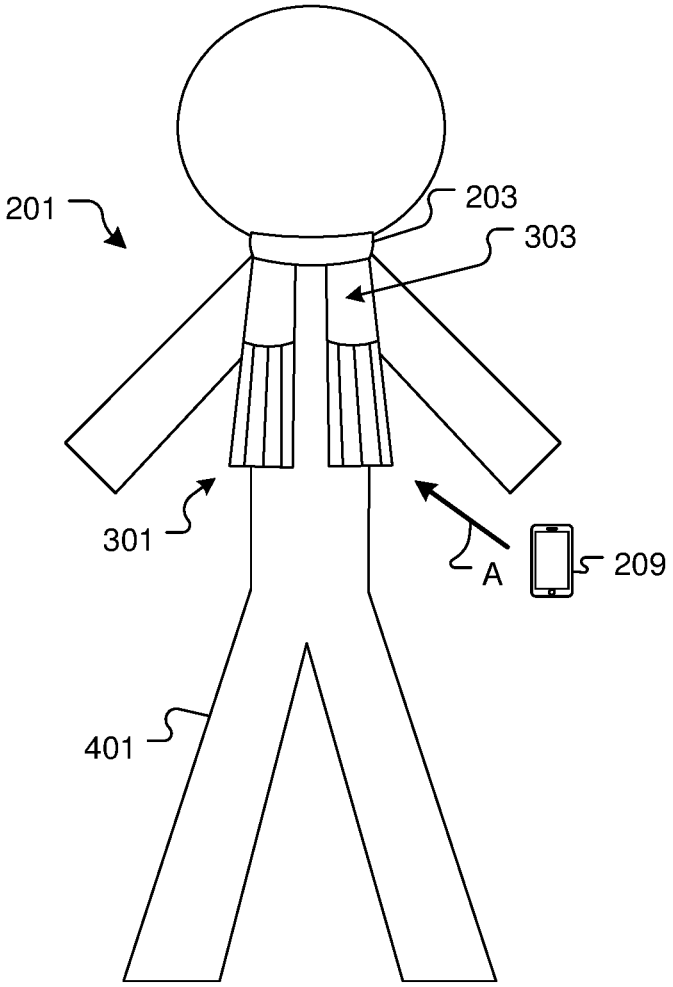
FIGS. 4A and 4B are front views of the system of FIGS. 2 and 3 in use.
Figure 4B:
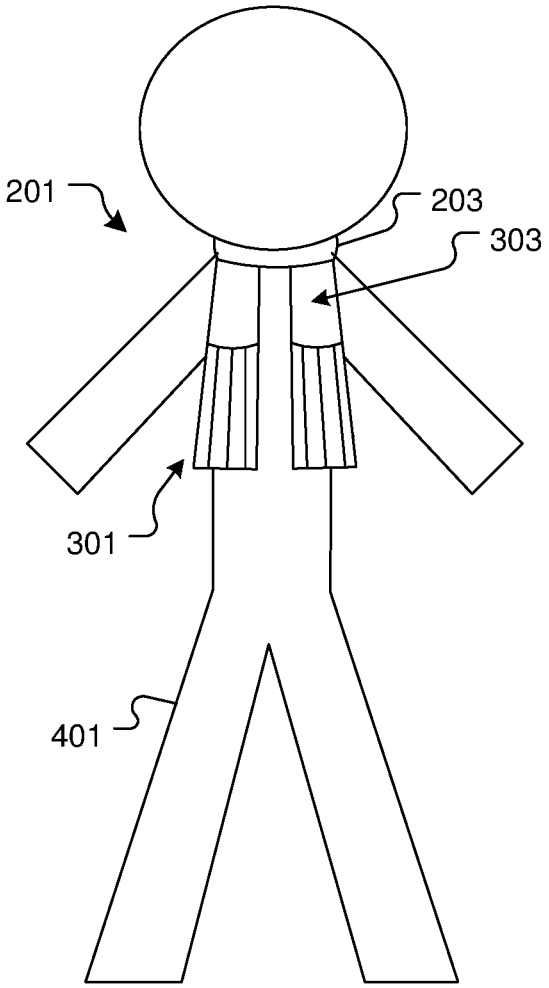

Referring now to FIGS. 4A and 4B the system 201 is depicted in use. Personal effects 209 are hidden as depicted by motion A within the pouch 205 behind gathers 301 of garment 203 such that the effects 209 are hidden from view when garment 203 is carried by the person 401.

It should be appreciated that one of the unique features believed characteristic of the present application is that the gathers 301 of garment 203 conceal the existence of the closable pouch 205. The gathers 301 disrupt the natural flow of the garment 203 front surface 303. These disruptions disguise the presence of the closeable pouch 205. It is understood that by concealing closeable pouch 205 in this manner a potential thief is less likely to identify the personal effects 209 or the person 401 as targets.

The particular embodiments disclosed above are illustrative only, as the embodiments may be modified and practiced in different but equivalent manners apparent to those skilled in the art having the benefit of the teachings herein. It is therefore evident that the particular embodiments disclosed above may be altered or modified, and all such variations are considered within the scope and spirit of the application. Accordingly, the protection sought herein is as set forth in the description. Although the present embodiments are shown above, they are not limited to just these embodiments, but are amenable to various changes and modifications without departing from the spirit thereof.

What is claimed is:

1. A secretive multipurpose carrying system comprising:

a garment having a front surface and a back surface, the garment is provided with an integral closable pouch accessible from the back surface of the garment;

a zipper configured to close the closable pouch; and a plurality of gathers attached to the front surface of the garment, the plurality of gathers running vertical on the front surface and adjacent to one another on the front surface of the garment and configured to conceal the presence of the pouch as well as effects stored in the closable pouch; wherein the garment is a scarf.

* * * * *